US008506428B2

(12) United States Patent
Davies

(10) Patent No.: US 8,506,428 B2
(45) Date of Patent: Aug. 13, 2013

(54) HOCKEY NET ATTACHMENT MECHANISM

(75) Inventor: Steven A. Davies, Toronto (CA)

(73) Assignee: Diesel Management Inc., Toronto (CA)

( * ) Notice: Subject to any disclaimer, the term of this patent is extended or adjusted under 35 U.S.C. 154(b) by 266 days.

(21) Appl. No.: 13/110,156

(22) Filed: May 18, 2011

(65) Prior Publication Data

US 2012/0295741 A1 Nov. 22, 2012

(51) Int. Cl.
*A63B 69/00* (2006.01)

(52) U.S. Cl.
USPC ..... 473/478

(58) Field of Classification Search
USPC ..... 473/478, 415, 416, 157, 197, 494; 273/400; 211/105.2; D8/376
See application file for complete search history.

(56) References Cited

U.S. PATENT DOCUMENTS

| | | | | |
|---|---|---|---|---|
| 5,842,939 | A | 12/1998 | Pui et al. | |
| 6,723,011 | B1 | 4/2004 | Van Helvert et al. | |
| 2003/0181264 | A1* | 9/2003 | Yoon | 473/421 |
| 2003/0181267 | A1* | 9/2003 | Lee | 473/478 |
| 2004/0072633 | A1* | 4/2004 | Webb | 473/478 |
| 2011/0059815 | A1* | 3/2011 | Jones | 473/435 |
| 2012/0178555 | A1* | 7/2012 | O'Scanaill | 473/478 |
| 2012/0295741 | A1* | 11/2012 | Davies | 473/478 |

* cited by examiner

*Primary Examiner* — Gene Kim
*Assistant Examiner* — M Chambers
(74) *Attorney, Agent, or Firm* — Aaron Edgar; Gowling Lafleur Henderson LLP

(57) ABSTRACT

A hockey goal frame and a hockey goal frame with a mesh net assembly are disclosed. The hockey goal frame includes two vertical posts joined by a crossbar that defines a forward frame. The forward frame is supported by a lower supporting member. The forward frame and lower supporting member have attachments wires for accepting an attachment tab from a mesh net in order to attach the mesh net to the frame. The attachment tabs have two complimentary hook-and-loop fasteners that are coupled to surround the attachment tab around the attachment wires.

7 Claims, 7 Drawing Sheets

HOCKEY NET ATTACHMENT MECHANISM

FIELD

The present disclosure relates generally to a hockey goal frame and an attached mesh net.

BACKGROUND

Many games use a goal that provides a well defined frame into which a ball, puck or similar object must cross through in order to advance the score of the game. A mesh net is attached to the frame to retain the ball or puck within the goal. These games can be played indoors or outdoors and the mesh net can be subject to damage from play or the elements.

When a mesh net is damages it must typically be replaced in a timely manner to avoid a prolonged interruption to the game. A typical hockey goal, for example, includes around 150 net tie bar welds or eyelets along the frame that requires the use of a single nylon cord or rope to attach the mesh net to the frame. The cord or rope is threaded through these eyelets and at the same time, woven in and out through the opening in edge portions of the mesh net. Stringing the cord or rope through each of the 150 net tie bar welds is a lengthy process that can take between 30 and 45 minutes to attach the mesh net. This makes this attachment method impractical for nets that may frequently become damaged or a portable net that is often assembled and dissembled. Also, the string used to attach the net is a single point of failure that, if broken, such as by a skate, can result in the mesh net becoming detached from the frame.

The sporting goal described in U.S. Pat. No. 5,842,939 has a hook-and-loop connecting means attached to the frame of the goal and complementary hook-and-loop connecting meant attached to the mesh net in order to affix the net to the goal frame. U.S. Pat. No. 5,842,939 also describes an alternative where the mesh net has complementary hook-and-loop fasteners to form a sleeve around the frame of the goal without hook-and-loop fasteners on the frame itself. The sport net assembly described in U.S. Pat. No. 6,723,011 provides an attachment member that can be coupled around the frame assembly using complimentary hook-and-loop fasteners.

These approaches that surround the frame with mesh net attachment means have a number of disadvantages. Since the attachment means cover forward edge of the frame, it is subject to significant wear from the impact of players and the ball or puck. The attachment means covering the bottom edge of the frame is subject to significantly more wear from dragging or moving the goal over the playing surface. The attachment means also interferes with the goal by changing the resilience and sonic qualities of the frame compared to a metal frame without the surrounding attachment means. Since the forward frame defines the goal opening, using thicker net attachment means alters the size of the opening and the goal may not strictly conform to rules for size of the goal.

SUMMARY

According to a first aspect, a hockey goal frame is provided comprising two vertical goal posts supporting a crossbar defining a forward frame, a lower supporting member attached to a lower portion of each of the two vertical goal posts, and a plurality of hook-and-loop fastener attachment wires on a rear facing portion of the forward frame to define an opening between the attachment wires and the forward frame. In some aspects, the attachment wires define a length of the opening to be larger than 3 inches. In other aspects, the hockey goal frame is comprised of modular frame sections coupled by outwardly biased connection buttons for mating with holes in an adjoining modular frame section.

According to a second aspect, a hockey goal assembly is provided having a hockey goal frame and a mesh net. The hockey goal frame is comprised of two vertical goal posts supporting a crossbar that define a forward frame, a lower supporting member attached to a lower portion of each of the two vertical goal posts, and a plurality of hook-and-loop fastener attachment wires on a rear facing portion of the forward frame and on an upper surface of the lower supporting member that define a number of openings between the attachment wires and the hockey goal frame. The mesh net has attachment tabs that have complimentary hook-and-loop fasteners, the attachment tabs engage the attachment wires through the openings to couple the mesh net to the forward frame and lower supporting member. In other aspects, the attachment tabs are color coded to correspond to a colored portion of the hockey goal frame.

BRIEF DESCRIPTION OF THE DRAWINGS

For a better understanding of the various embodiments described herein and to show more clearly how they may be carried into effect, reference will now be made, by way of example only, to the accompanying drawings which show at least one exemplary embodiment, and in which.

DESCRIPTION OF VARIOUS EMBODIMENTS

It will be appreciated that for simplicity and clarity of illustration, where considered appropriate, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementations of various embodiments described herein.

Although the embodiment described herein explicitly refers to a hockey net, it will be understood by those of ordinary skill in the art that the teachings described herein may be applied to other sports goals. For example, and without limitation, other embodiments can include sporting goals used for ice hockey, road hockey, field hockey, handball, lacrosse, polo, water polo, or other sports requiring a goal frame with an attached mesh net.

Figure 1:
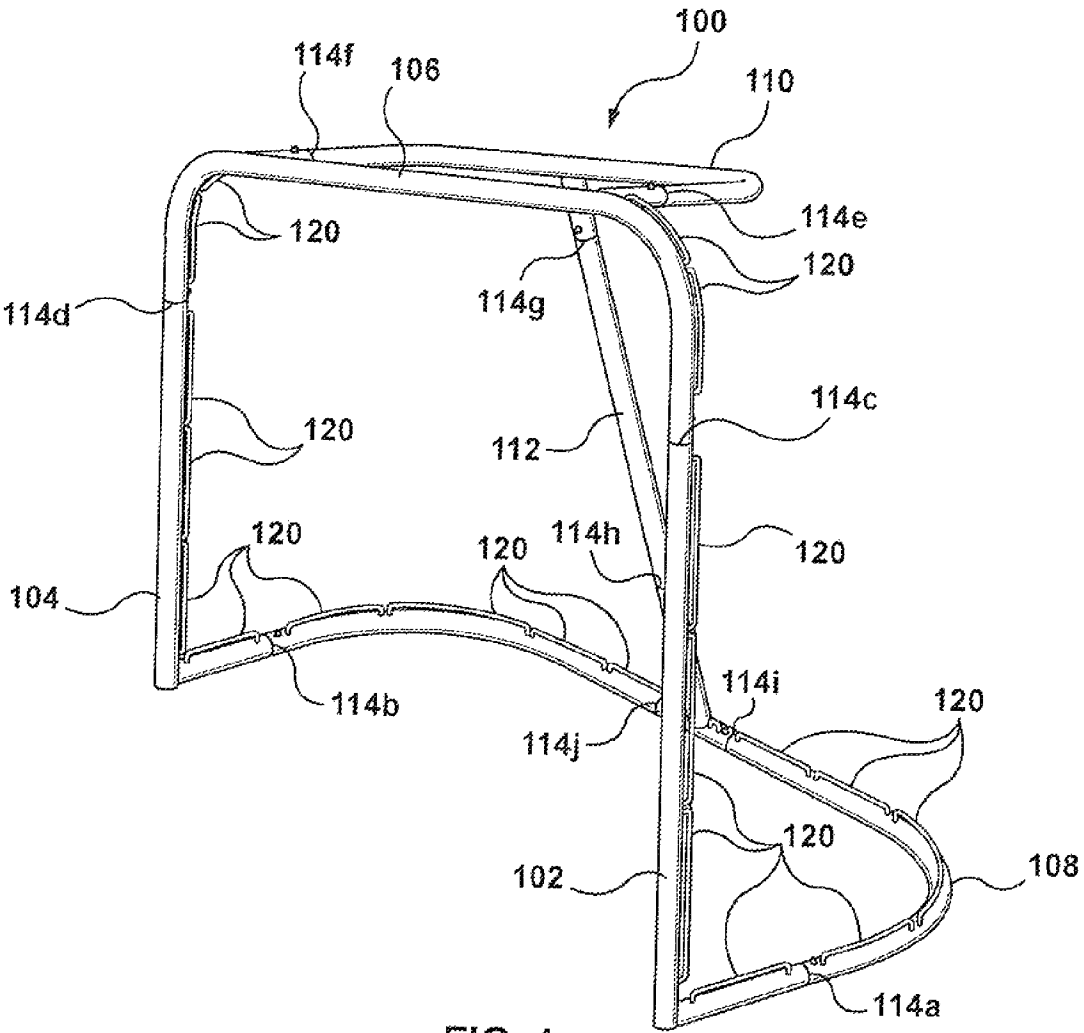
FIG. 1 is a is a perspective view of a hockey goal frame with the mesh net omitted.
Figure 2:
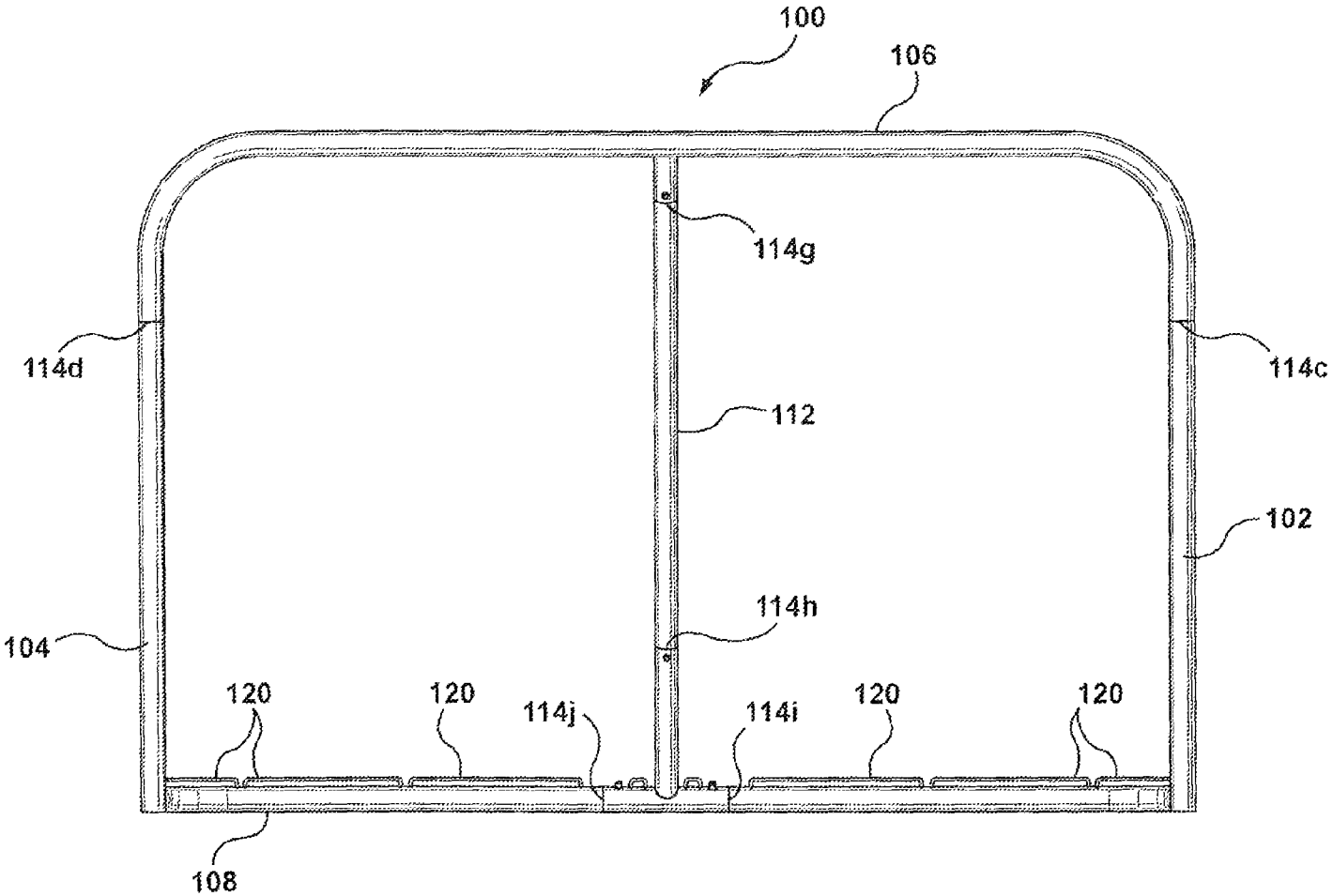
FIG. 2 is a front view of the hockey goal frame shown in FIG. 1.
Figure 3:
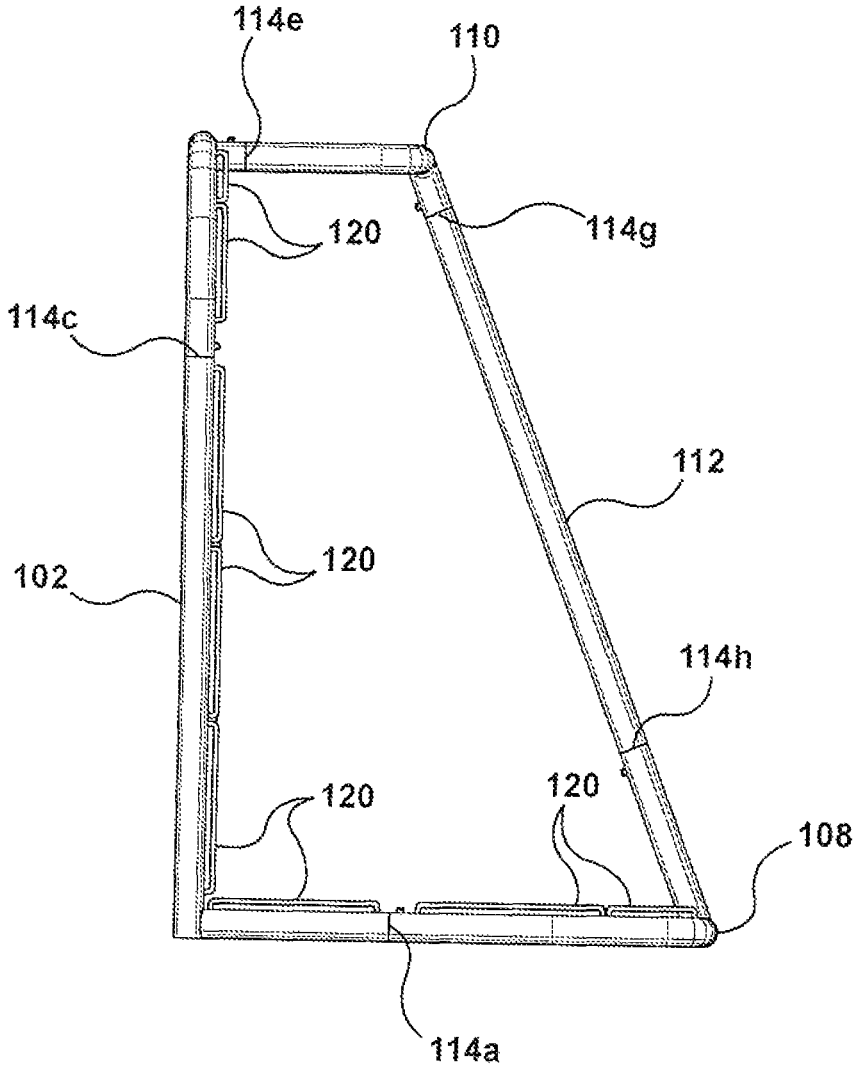
FIG. 3 is a side view of the hockey goal frame shown in FIG. 1.
Figure 4:
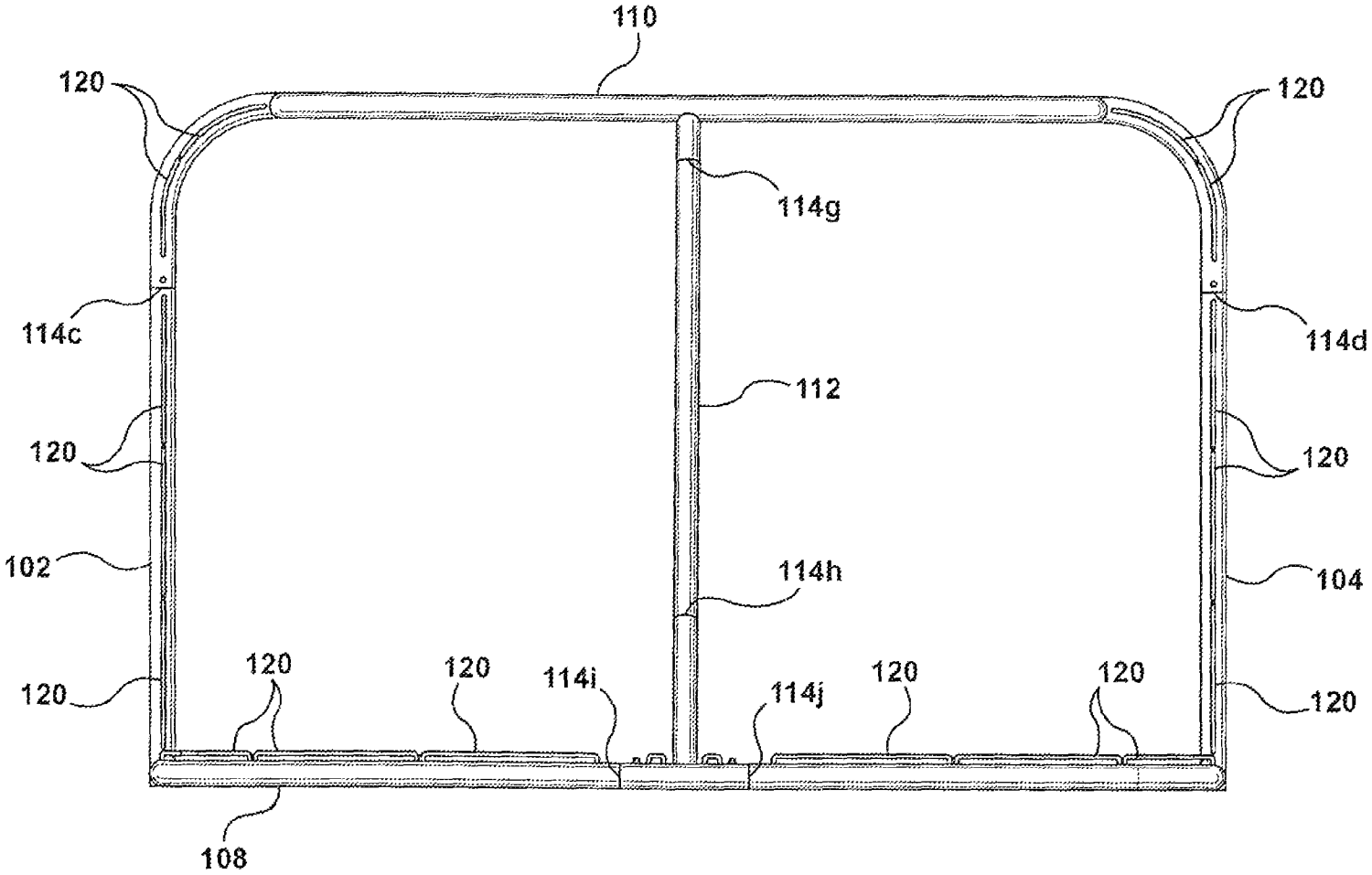
FIG. 4 is a rear view of the hockey goal frame shown in FIG. 1.

Reference is first made to FIGS. 1-4, FIG. 1 is a perspective view of a hockey goal frame 100 with the mesh net omitted. FIGS. 2 through 4 provide a front view, side view, and rear view, respectively, of hockey goal frame 100 shown in FIG. 1. Vertical goal posts 102 and 104 support a crossbar 106 that defines the forward facing opening of goal frame 100. A puck or other play implement that passes through the plane defined by the opening will be recorded as a goal for the offensive team. A lower portion of vertical goal posts 102, 104 are connected to a lower supporting member 108 that extends rearward from vertical posts 102, 104. Lower supporting member 108 supports hockey goal frame 100 on the playing surface. Net supporting member 110 is D-shaped and extends rearwardly from crossbar 106 substantially level with the playing surface. Net supporting member 110 has a typically smaller length and width than lower supporting member 108. A vertical support 112 connects between a middle portion of the net supporting member 110 and a middle portion of net supporting member 108. When a mesh net is installed on hockey goal frame 100 the net will drape over top of net supporting member 110 and vertical support 112.

The frame members of hockey goal frame 100 are typically tubular or substantially tubular, but alternative embodiments may be constructed with frame members having non-cylindrical cross-sections. The frame members are also typically constructed from a light weight metal although alternative embodiments may use other materials, such as, for example, a high density plastic.

Hockey goal frame 100 can also include mating connectors 114*a-j* that allow frame members to be connected and disconnected from each other in order to assemble and dissemble hockey goal frame 100 for storage and portability. Mating connectors 114*a-j* can include a reduced diameter section at the end of the frame member for insertion into an adjoining frame member. Mating connectors 114*a-j* can further include a button on the reduced diameter section that can be depressed when inserted into an adjoining mating connector and resiliently returns to engage a hole in the adjoining mating connector.

Vertical goal posts 102, 104 can also have a downward facing opening in the bottom portion that can be used to receive a flexible insert to couple hockey goal frame 100 to a fixed position on the playing surface.

In an example embodiment of hockey goal frame 100, vertical goal posts 102, 104 can extend 4 feet above the playing surface and are set 6 feet apart measured from the inside of vertical goal posts 102, 104. Vertical goal posts 102, 104 can be painted in red or an other high contrast color with respect to the playing surface, the play implement (i.e. ball or puck), or other equipment. All other exterior surfaces can be painted in white or a low contrast color with respect to the playing surface, the play implement (i.e. ball or puck), or other equipment.

Vertical goal posts 102, 104, crossbar 106, and lower supporting member 108 each have attachment wires 120 that are used to affix mesh net 130 as shown in FIG. 2. Attachment wires 120 on vertical goal posts 102, 104 and crossbar 106 are oriented to face substantially rearwards from the forward facing opening of hockey goal frame 100. Attachment wires 120 on lower supporting member 108 are oriented upwards from the playing surface.

Figure 5:
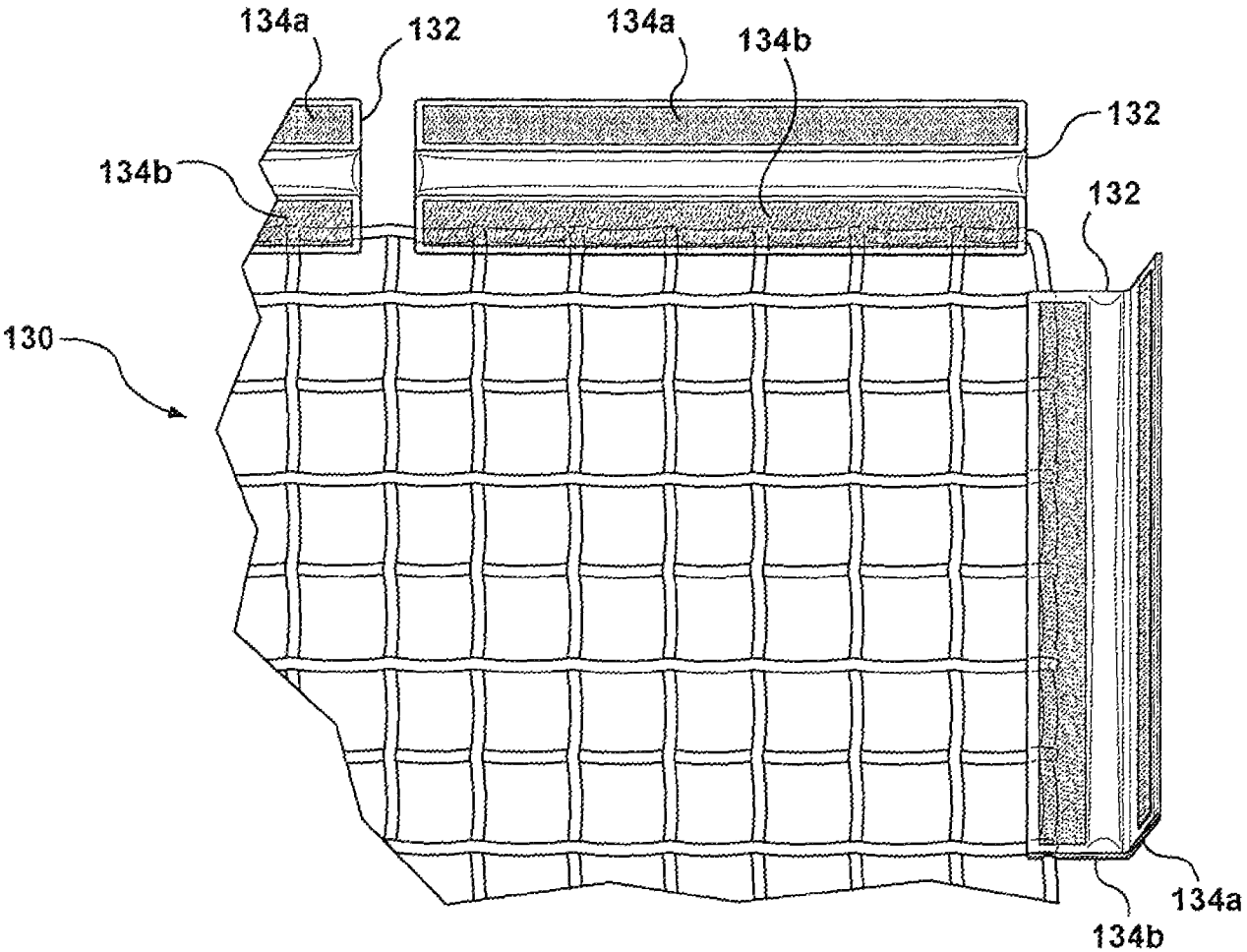
FIG. 5 shows a mesh net illustrating attachment tabs having complementary hook-and-loop fasteners.

Referring now to FIG. 5, shown is mesh net 130 illustrating attachment tabs 132 having complementary hook-and-loop fasteners 134*a* and 134*b* affixed thereto. Attachment tabs 132 can be constructed from a heavy duty nylon fabric or any other durable fabric composed of either natural or synthetic fibers. Hook-and-loop fasteners 134*a* and 134*b* are coupled to attachment tabs 132 either by sewing, adhesive or a combination thereof. Attachment tabs 132 are coupled to mesh net 130 in order to affix attachment tabs 132 to a fixed position along the edge of mesh net 130.

Figure 6C:
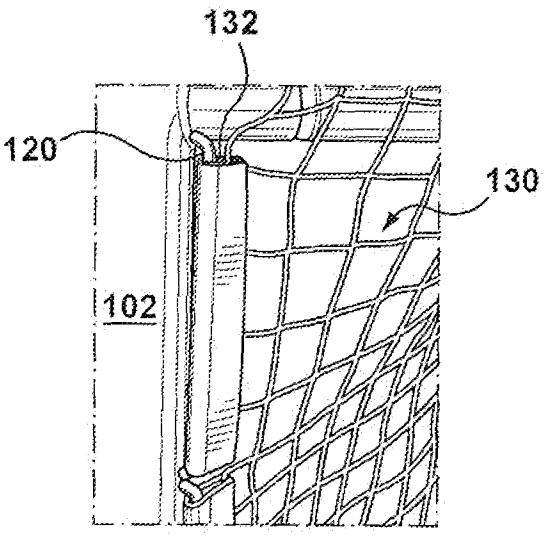
FIG. 6C is a sectional view of hockey goal frame of FIG. 1 illustrating attachment tabs of the mesh net of FIG. 5 surrounding attachment wire; end
Figure 6B:
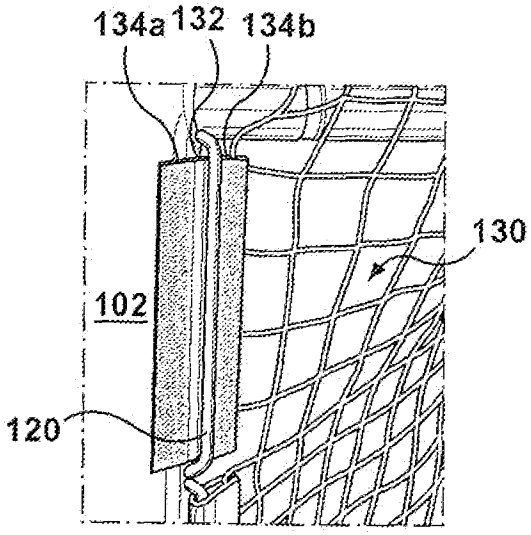
FIG. 6B is a sectional view of hockey goal frame of FIG. 1 illustrating attachment tabs of the mesh net of FIG. 5 between attachment wire and hockey goal frame.
Figure 6A:
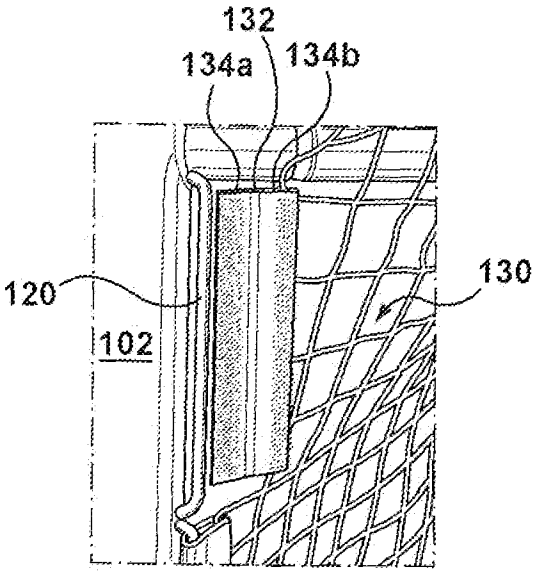
FIG. 6A is a sectional view of hockey goal frame of FIG. 1 illustrating attachment tabs near attachment wire and mating complementary hook-and-loop fasteners used to affix the mesh net of FIG. 5.
Figure 7:
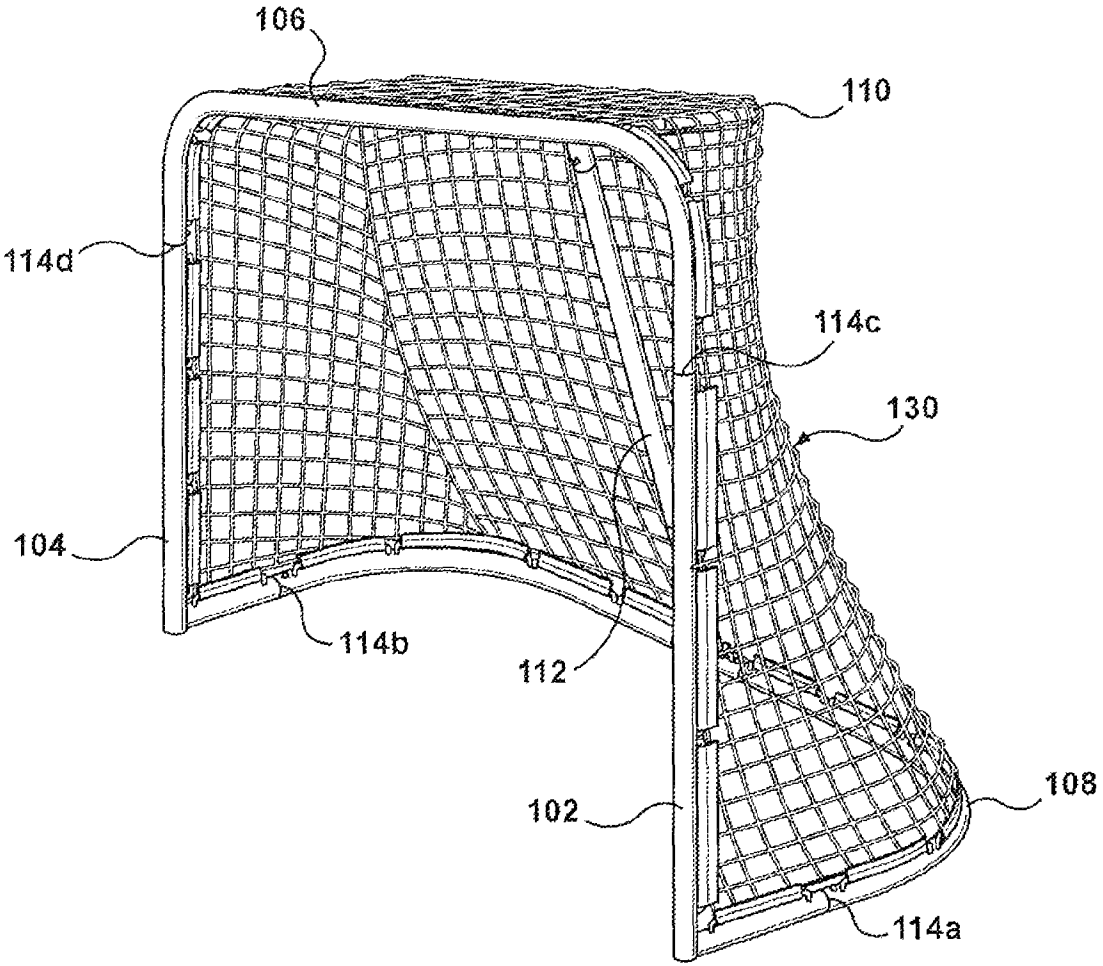
FIG. 7 is a perspective view of a hockey goal frame of FIG. 1 with the mesh net attached.

Reference is next made to FIGS. 6A-C, is a sectional view of hockey goal frame 100 illustrating attachment tabs 132 surrounding attachment wires 120 and mating complementary hook-and-loop fasteners 134*a* and 134*b* to affix mesh net 130. Attachment wires 120 are shaped to allow a rectangular shaped attachment tab 132 of mesh net 130 to be inserted in the opening defined by attachment wires 120 and the frame members, such as vertical goal post 102. FIG. 7 provides a perspective view of hockey goal frame 100 with mesh net 130 attached.

Using rectangular attachment tabs 132 allows for a sufficient amount of hook-and-loop fastener material to provide sufficient strength to affix mesh net 130 to withstand impact from the puck, playing implement or from players. Known hockey goal frames typically use small 1.5 inch long net tie bar eyelets that require weaving a nylon cord through the eyelets and the mesh net in order to affix the net to the frame. This is a time consuming process and requires some experience to position the mesh net on the frame and correctly weave the cord between the net and the proper eyelets.

Attachment wires 120 are substantially longer, and since there are fewer attachment wires than tie bar eyelets on a known hockey goal frames, this enable mesh net 130 to be attached much quicker than to prior hockey goal frames. Using a larger attachment wires also allows hockey goal frame 100 to be manufactured at a lower cost since fewer welds are required to affix attachment wires 120 to hockey goal frame 100 compared to traditional tie bar eyelets.

The length of the attachment wires 120 can vary by their position along the hockey goal frame 100 such that areas mesh net 130 that are subject to more stress can use longer attachment wires 120 that provide for a greater strength through increased surface area of hook-and-loop fasteners 134*a* and 134*b*. The length of the attachment wires 120 and corresponding attachment tabs 132 is typically 3 inches or longer to provide sufficient strength from hook-and-loop fasteners 134*a* and 134*b*. The length of the attachment wires 120 and the corresponding attachment tabs 132 can vary with some embodiments including a range between 3 to 15 inches, other embodiments using ranges between 4 to 12 inches, or still other embodiments using ranges between 4 to 9 inches. The aforementioned ranges do not include attachment wires 120 that is typically about 3 inches to cover the modular portion of the frame that may be too small to support a larger attachment wires, such as, for example, the portion of the lower supporting member 108 between mating connectors 114*i* and 114*j*.

The attachment wires 120 and attachment tabs 132 can be marked so that a specific attachment tab 132 is associated with a specific attachment wire 120 to aid in attaching the mesh net 130. For example, numbers or other identifiable markings can be placed on hockey goal frame 100 near each attachment wire 120 and each attachment tab 132 can be marked using the numbers or other identifiable marking to correspond to correct attachment wire 120. Alternatively, tabs 132 can be colored to match the portion of hockey goal frame where they are supposed to be attached. For example, typical ice hockey nets have a red vertical goal posts 102, 104, and crossbar 106 and a white lower supporting member 108; attachment tabs 132 can be colored red and white to identify where sections of mesh net 130 should attach to hockey goal frame 100.

While the exemplary embodiments have been described herein, it is to be understood that the invention is not limited to the disclosed embodiments. The invention is intended to cover various modifications and equivalent arrangements included within the spirit and scope of the appended claims, and scope of the claims is to be accorded an interpretation that encompasses all such modifications and equivalent structures and functions.

I claim:

1. A hockey goal frame comprising:

two vertical goal posts supporting a crossbar, the two vertical goal posts and crossbar defining a forward frame;

a lower supporting member attached to a lower portion of each of the two vertical goal posts; and a plurality of attachment wires on a rear facing portion of the forward frame and an upper surface of the lower supporting member to define a plurality of openings shaped to receive a corresponding one of a plurality of rectangular attachment tabs each having complimentary hook-and-loop fasteners, the openings provided between the hockey goal frame and the attachment wires, wherein rectangular attachment tabs are coupled to a mesh net and each of the attachment tabs engages a corresponding one of the plurality of attachment wires to attach the mesh net to the hockey goal frame.

2. The hockey goal frame of claim 1 further comprising a D-shaped net supporting member attached to a rear facing portion of the crossbar.

3. The hockey goal frame of claim 2 further comprising a vertical support connecting a middle portion of the net supporting member to a middle portion of the lower supporting member.

4. The hockey goal frame of claim 3 further comprised of modular frame sections coupled by outwardly biased connection buttons for mating with holes in an adjoining modular frame section.

5. A hockey goal assembly comprising:

a mesh net having a plurality of attachment tabs, each of the attachment tabs having complimentary hook-and-loop fasteners; and a hockey goal frame comprising two vertical goal posts supporting a crossbar, the two vertical goal posts and crossbar defining a forward frame;

a lower supporting member attached to a lower portion of each of the two vertical goal posts; and a plurality of attachment wires on a rear facing portion of the forward frame and on an upper surface of the lower supporting member that define a plurality of openings, each shaped to receive a corresponding one of the plurality of rectangular attachment tabs, between the hockey goal frame and the attachment wires, wherein each one of the plurality of attachment tabs engages a corresponding one of the plurality of the attachment wires to couple the mesh net to the forward frame and lower supporting member.

6. The hockey goal assembly of claim 5 further comprising a D-shaped net supporting member attached to a rear facing portion of the crossbar.

7. The hockey goal assembly of claim 5 wherein the attachment tabs are color coded to correspond to colored portions of the hockey goal frame.

* * * * *